US005899143A

United States Patent [19]

Niestrath et al.

[11] Patent Number: 5,899,143

[45] **Date of Patent: *May 4, 1999**

[54] METHOD AND APPARATUS FOR PRINTING ON INDIVIDUAL SELF-SUPPORTING ARTICLES

[75] Inventors: Hans-Dieter Niestrath, Hiddenhausen; Norbert Rohwetter, Bünde, both of Germany

[73] Assignee: Werner Kammann Maschinenfabrik GmbH, Bünde, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/843,176

[22] Filed: Apr. 14, 1997

[30] Foreign Application Priority Data

Apr. 15, 1996 [DE] Germany ..... 196 14 740

[51] Int. Cl.[6] ..... B41F 15/10

[52] U.S. Cl. ..... 101/129

[58] Field of Search ..... 101/129

[56] References Cited

U.S. PATENT DOCUMENTS

| | | | |
|---|---|---|---|
| 4,024,813 | 5/1977 | Thiene et al. . | |
| 4,610,200 | 9/1986 | Metso | 101/126 |
| 4,945,829 | 8/1990 | Ericsson | 101/129 |
| 4,953,459 | 9/1990 | Ericsson | 101/129 |
| 4,981,074 | 1/1991 | Machita et al. | 101/129 |
| 5,176,078 | 1/1993 | Homma et al. | 101/129 |
| 5,272,980 | 12/1993 | Takeuchi et al. | 101/485 |
| 5,591,773 | 1/1997 | Grunberger et al. | 514/532 |

FOREIGN PATENT DOCUMENTS

| | | |
|---|---|---|
| 0 127 831 A2 | 12/1984 | European Pat. Off. . |
| 0 187 125 B1 | 1/1990 | European Pat. Off. . |
| 0 488 092 A1 | 6/1992 | European Pat. Off. . |
| 0 581 378 A1 | 2/1994 | European Pat. Off. . |
| 0 488 092 B1 | 6/1995 | European Pat. Off. . |
| 39 04 863 A1 | 8/1990 | Germany . |
| 3904863 A1 | 8/1990 | Germany . |
| 40 11 223 A1 | 9/1990 | Germany . |
| 40 37 678 A1 | 6/1992 | Germany . |
| 42 17 430 A1 | 12/1993 | Germany . |
| 43 32 498 A1 | 3/1995 | Germany . |
| 44 33 905 A1 | 4/1995 | Germany . |
| 44 32 371 A1 | 3/1996 | Germany . |
| 07108669 | 4/1995 | Japan . |
| WO95/00336 | 1/1995 | WIPO . |

OTHER PUBLICATIONS

"A Nested Object Within The Page Coordinate Space", *IBM Technical Disclosure Bulletin*, vol. 30, No. 9, Feb., 1988.

*Primary Examiner*—Edgar Burr
*Assistant Examiner*—Amanda B. Sandusky
*Attorney, Agent, or Firm*—Panitch Schwarze Jacobs & Nadel, P.C.

[57] ABSTRACT

In a method of printing on individual self-supporting articles, for example CDs, telephone cards or the like, using multi-color printing, the relative positions of the individual print images which make up a total print image on the article are set by a procedure whereby, after at least one individual print image has been printed on the article, the print image is detected by a camera system. The representation of the actual position of the individual print image relative to the article bearing it is compared in a computer to a representation of the reference position stored therein. In dependence on the result of the comparison, if the actual position deviates from the reference position, the position of the printing mechanism and/or the position of a following article is altered for the printing operation in accordance with the result of the comparison.

9 Claims, 10 Drawing Sheets

METHOD AND APPARATUS FOR PRINTING ON INDIVIDUAL SELF-SUPPORTING ARTICLES

FIELD OF THE INVENTION

The present invention concerns a method and an apparatus for printing on individual self-supporting articles and more particularly those articles whose extent perpendicularly to the at least one surface to be printed upon is generally relatively small.

Such articles may include for example CDs, telephone cards, credit cards and the like.

BACKGROUND OF THE INVENTION

Particularly when printing on articles such as CDs, telephone cards and credit cards, very small batch sizes frequently have to be printed. Batch sizes of only several hundred CDs or telephone cards are not a rarity. The consequence of this is that a disproportionately great amount of time is required for converting the printing machine from one batch to the next. In addition, with the machines which are usually employed nowadays. The conversion operation in that situation, that is to say adjusting the printing mechanisms to the print image of the respective following batch, requires very well-trained operating personnel if a print image of high quality is to be produced. In that respect, it will be noted that the requirements in terms of print image quality are becoming increasingly strict.

EP 0 488 092 B1 discloses a screen printing machine for printing on material in web form, wherein register marks applied to the web material are monitored by means of a camera. The screen printing stencils are arranged to be adjustable and for that purpose they are provided with setting motors which are controllable by way of a computer in dependence on the positions of the register marks, detected by the camera. However, adjusting the screen printing stencils in dependence on the position of register marks on the material to be printed does not result in significantly making the operation of converting the printing machine easier. Furthermore the quality of print image which can be achieved therewith does not satisfy the requirements which are usually imposed in many cases nowadays.

SUMMARY OF THE INVENTION

An object of the present invention is to provide a method of printing an individual self-supporting articles which permits a rapid change from one printing mode or batch to another without a loss of print image quality.

Another object of the present invention is to provide a method of printing on individual self-supporting articles which permits the printing procedure to be changed over rapidly from one batch mode to another with a very substantially automatic procedure.

Yet another object of the present invention is to provide a method of printing on individual self-supporting articles which affords a straightforward, rational and substantially automatic procedure while achieving good quality of a generally multi-color print image.

Still a further object of the present invention is to provide an apparatus for printing on individual self-supporting articles which is adapted to provide for rapid conversion from one print mode or batch to another, without a loss of print quality.

In a first aspect, in accordance with the present invention, the foregoing and other objects are attained by a method of printing on individual self-supporting articles with at least two individual print images which are to be successively applied to the article by means of respective printing mechanisms and which on the article supplement each other to make up a total print image. After the operation of printing on the article with at least one individual print image it is detected by a camera system and the representation of the actual position of the individual print image relative to the article bearing it is compared in a computer to a stored representation of the reference or target position of the individual print image and in dependence on the result of the comparison, in the event of the actual position of the individual print image deviating from the reference position thereof, the position of the printing mechanism and/or the position of a following article for the printing procedure is altered in accordance with the result of the comparison.

As will be seen in greater detail hereinafter from a description of preferred embodiments of the invention, an advantage thereof is that it detects the print image and thus the direct result of the printing procedure, and uses that result as a measure in terms of assessing the quality achieved, the latter being essentially determined by the individual print images being correctly positioned on the article so that all the individual print images supplement each other in the optimum fashion to make up the overall print image. When the machine is converted for printing a fresh batch of articles, for example in the case of a screen printing machine, it is only necessary for the screen printing stencils that are required for the fresh batch to be firstly coarsely oriented and adjusted in the hitherto usual manner, that is to say essentially manually. The amount of time required for that purpose is comparatively small. Fine alignment, that is to say accurate matching of the individual screen printing stencils to the article and thus of the individual print images relative to each other, is effected automatically, more specifically by virtue of the procedure involving detecting the print image by means of the camera system and comparing the detected actual print image or the position thereof to the stored reference or target print image position.

Production of the reference print image and storage thereof does not involve any difficulty. It is thus possible to input into the computer the individual print images which can also be assembled therein to constitute the resulting total print image. The individual print images may be for example in the form of the usual diapositives or positive transparencies which are to be transferred on to the screen printing stencil. The diapositives can be individually recorded by the camera, in which respect it is only necessary to ensure by way of register marks or the like which are present in any case that, in the recording operation, each diapositive is in a defined position. It is however also readily possible for the individual print images to be inputted into the memory means of the computer, in the form of digital data, using a diskette or the like.

In another feature of the invention, when applying the individual print image to the article using a printing cylinder, that is to say for example by means of an offset printing process, it may be advantageous, in the event of the actual position of the individual print image deviating from the reference position, to suitably alter not the position of the printing mechanism but that of the following article for carrying out the printing procedure. This means that the article is subjected to suitable alignment, before it is printed upon. It will be appreciated that it would also be possible to proceed in that way, when using screen printing. In the case of a screen printing mechanism however, by virtue of its simplicity of structure, it is generally easier to adjust the printing mechanism, that is to say the stencil, relative to the article which is disposed in a holder and is in a given position, in the printing operation.

In accordance with another preferred feature of the invention, after adaptation of the actual position of each individual print image to the reference or target position, the operation of printing on the following articles can be carried out without continuing comparison between the actual position and the reference position. That will generally be readily possible when printing small batch sizes as there is a comparatively low risk of the actual position of the one or other individual print images subsequently changing.

On the other hand however, in accordance with another preferred feature of the invention, it is also possible for the actual print images to be detected while production is going on and to be compared to the respective reference print image so that deviations can be immediately detected and corrected. Irrespective of whether only the initial setting of the position of the printing mechanisms and/or the position of an article to be printed upon is monitored or whether in addition ongoing production is also monitored, it is possible to detect the total print image formed by at least two individual print images, by means of a camera system, and to compare the representation of at least one actual position of at least one individual print image relative to the article bearing it in the computer to the representation of a stored reference position, and to effect a correction in dependence on the result of the comparison. The camera systems which are available nowadays for monitoring print images are capable of distinguishing colors and thus, when detecting the total print image which is made up of a plurality of individual print images, selecting a respective given individual print image which can then be compared in the computer to the reference print image associated therewith. Camera systems of those kind for 'resolving' the total print image are particularly suitable for monitoring ongoing production as they make it possible to manage with just one camera which then records only the total print image.

In a further aspect of the invention, the foregoing and other objects are attained by an apparatus for printing on individual self-supporting articles with at least two individual print images which are to be successively applied to an article and which supplement each other on the article to form a total print image. The apparatus includes at least first and second printing stations and possibly at least one further treatment station, and a transport means for transporting the articles through the stations. The apparatus includes at least one camera system. Each printing mechanism has an adjustably mounted screen printing stencil and setting motor means for setting same, which are adapted to be controlled by a computer connected to the camera system. At least one of the individual print images is detected by the camera system and the actual position of the individual print image which is ascertained in that way is compared to a stored reference position and the screen printing stencil with which the individual print image had been produced is adjusted in dependence on the result of the comparison.

In another apparatus aspect the apparatus comprises at least first and second printing stations and possibly at least one further treatment station, with a transport means for transporting the articles through the stations. The apparatus includes at least one camera system. The or each printing mechanism has a printing cylinder with which there is associated at least one plate cylinder and an impression cylinder while arranged in the transport direction upstream of the printing station is a means for aligning the article to be printed upon. The aligning station is provided with a guide surface which laterally defines the path of movement of the article, for one side thereof, and provided at a spacing from said guide surface, which spacing substantially corresponds to the extent of the article transversely to said transport direction, is a movable guide abutment means which is elastically urged towards the article disposed between it and the guide surface. Associated with the guide surface by means of which the article is oriented substantially transversely to its transport direction is at least one setting motor means by which the guide surface is pivotable and/or displaceable substantially parallel to the plane of transport movement of the article and transport of the article from the aligning station into the printing station is effected by an entrainment means which, for the purposes of positioning in the transport direction, is carried with the interposition of a setting motor means. The setting motor means for displacment of the guide surface and for positioning the entrainment means are controllable by a computer connected to the camera system and the setting motor means can be adjusted in dependence on the comparison of the actual position of the individual print image with the reference position thereof.

It will be seen therefore that the apparatuses used for carrying out the method according to the invention have setting motors which in dependence on the result of the comparison between the actual position and the reference position of the individual print images adjust the position of the printing mechanism and/or that of the article accordingly.

Further objects, features and advantages of the invention will be apparent from the following description of preferred embodiments.

DESCRIPTION OF PREFERRED EMBODIMENTS

Figure 1:
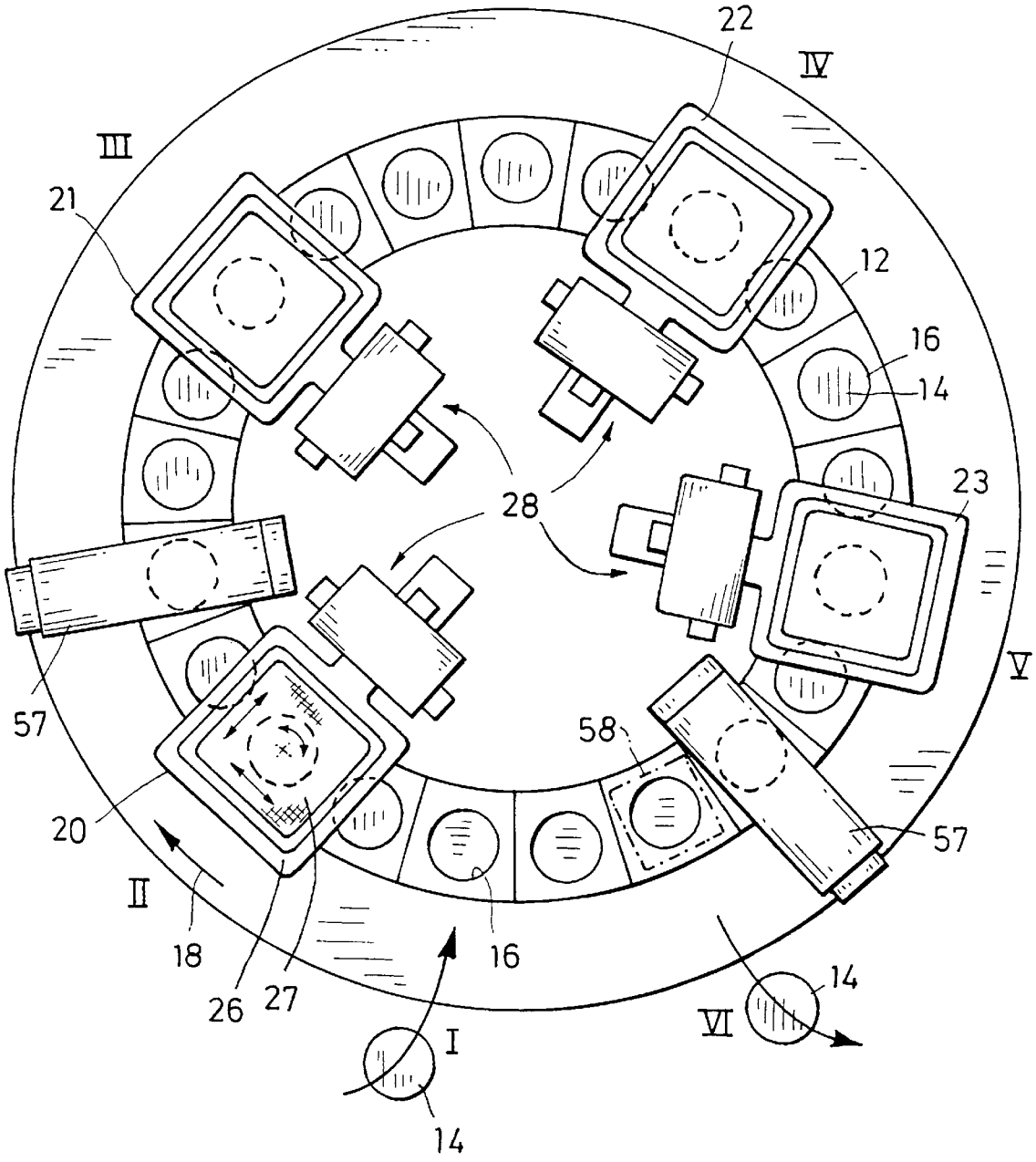
FIG. 1 is a plan view of an apparatus for printing on flat individual articles, using a screen printing procedure.

Referring firstly to FIG. 1, the apparatus illustrated therein for printing on individual self-supporting articles includes a main frame structure carrying a round annular table generally indicated at 12 which is rotatable about a vertical axis with a stepwise movement and which serves to hold and transport the individual articles 14 to be printed upon, which in this case are CDs. For that purpose the transport table 12 is provided with holders 16 which are arranged in an annular array coaxially with respect to the drive shaft of the table 12, adjacent the periphery thereof. Accordingly the individual articles 14 to be printed upon are transported along a circular transport path in the direction indicated by arrow 18 from a receiving station I at which the articles 14 are introduced on to the table 12 to a removal station VI from which the articles are removed. Disposed between the stations I and VI are at least first and second printing stations and possibly further treatment stations. The articles to be printed upon are fitted into the respective holder 16 disposed in the receiving station I by suitable arrangements which are operatively associated with the table 12 but which are not relevant to the present invention and which therefore will not be described in detail herein as such a detailed description would not be necessary for proper understanding thereof. At the removal station VI the respective printed article which has moved into that station is removed from its associated holder 16, by means of a suitable removal arrangement which is also not illustrated.

The apparatus is provided with four screen printing mechanisms as generally diagrammatically at 20, 21, 22 and 23, of which FIG. 1 respectively shows only the stencil frame 26 and a screen printing stencil 27 carried thereby.

Figure 5:
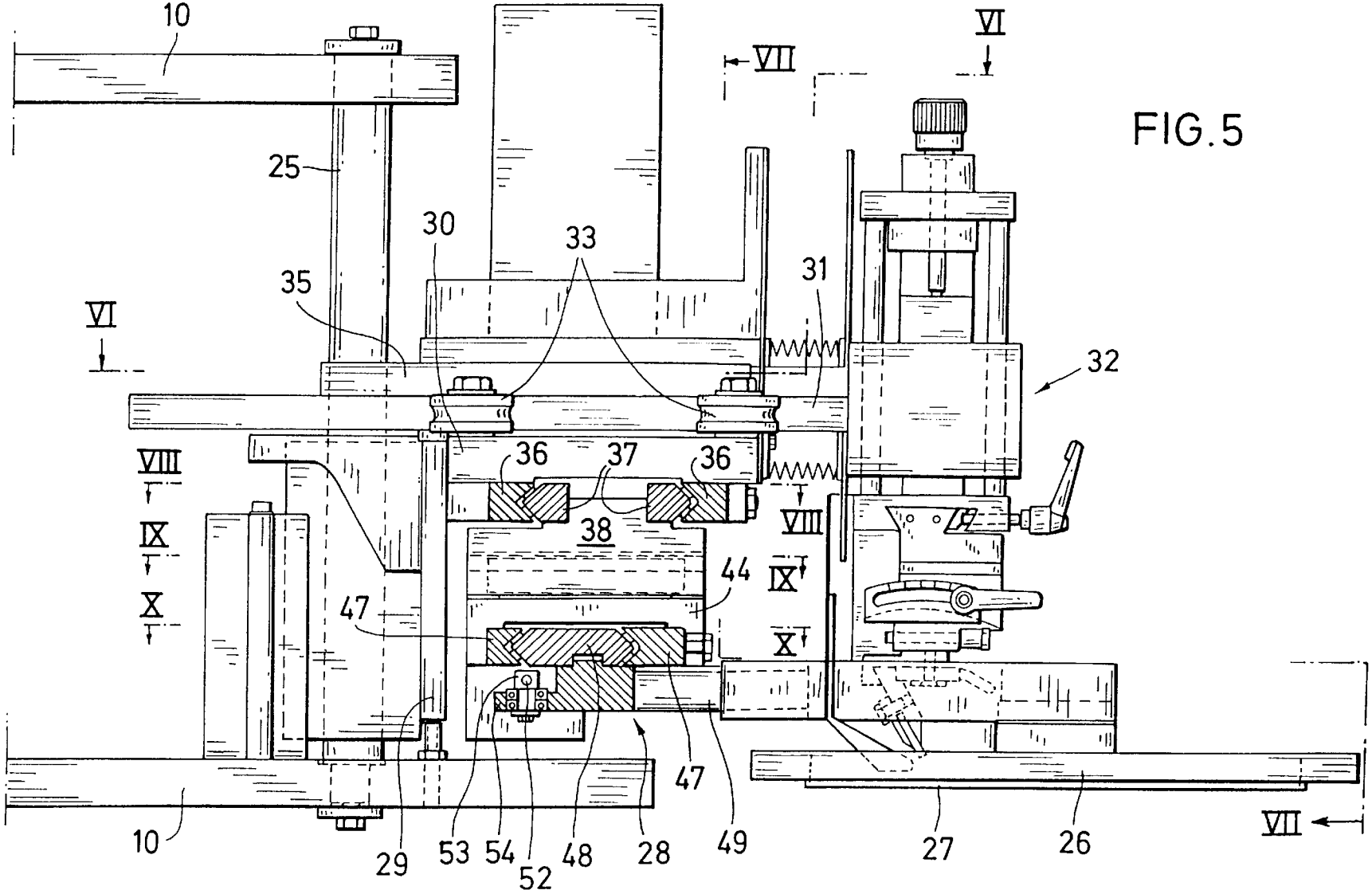
FIG. 5 is a side view on an enlarged scale of a screen printing mechanism with associated adjusting arrangement.

Reference will now be made to FIGS. 5 through 10 showing a diagrammatic view on an enlarged scale of an embodiment of a screen printing mechanism which is preferred at the present time. The screen printing mechanism which has a screen printing stencil 27 and a squeegee head 32 is guided on first and second pillars 25 of the machine frame structure 10 in such a way that it can be moved up and down thereon. FIG. 5 in particular shows that the printing mechanism has an upwardly extending vertical plate 29 which is connected to the machine frame structure 10 and which at its upper end carries a cantilever bracket 30 on which a holding bar 31 for the squeegee head 32 is horizontally displaceably mounted. The holding bar 31 is guided and held by four rollers 33 which are provided with a peripheral surface of an approximately V-shaped configuration and which co-operate with suitable lateral surfaces of the holding bar 31. The reciprocating movements of the holding bar 31 and therewith the squeegee head 32 are produced by a gear which is indicated at 34 in FIG. 6 and which meshes with a rack 35 fixedly connected to the holding bar 31 at the top side thereof.

Mounted to the underside of the bracket 30 are two guide rails indicated at 36 in FIG. 5, which are provided at their mutually facing sides with V-shaped recesses. Guided in the guide rails 36 are correspondingly profiled bar members 37 which are carried by a first slide or carriage 38. The carriage 38 is displaceable in the direction of the X-axis, that is to say perpendicularly to the plane of the drawing in FIG. 5, by a first control or setting motor which is indicated at 39 in FIG. 7 and whose spindle 40 is fixedly connected to the first carriage 38. The first setting motor 39 is carried by a plate indicated at 41 in FIG. 7, which is fixedly connected to the frame structure 10 of the apparatus.

Figure 7:
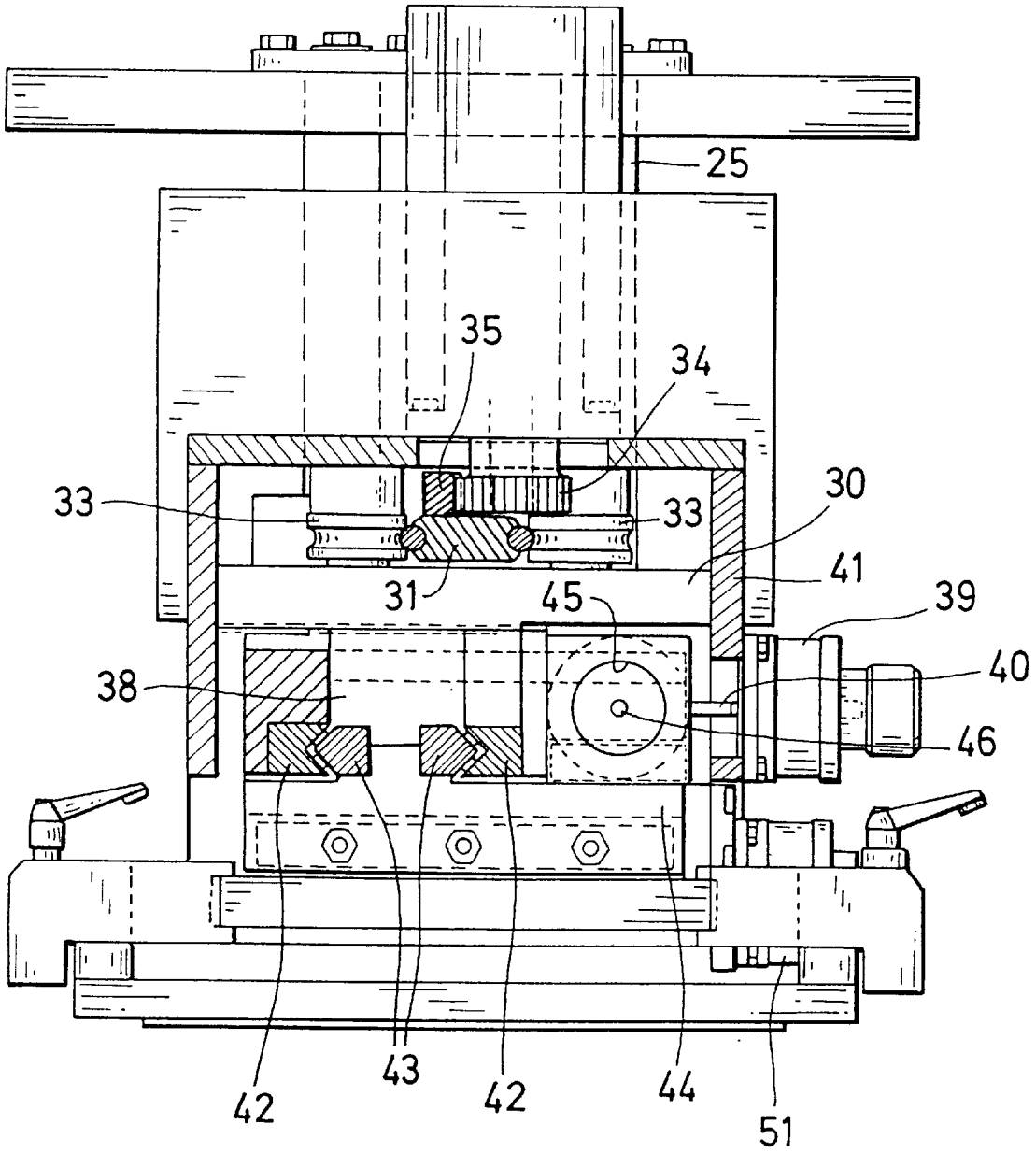
FIG. 7 is a view in the direction of the arrows VII—VII in FIG. 5.
Figure 8:
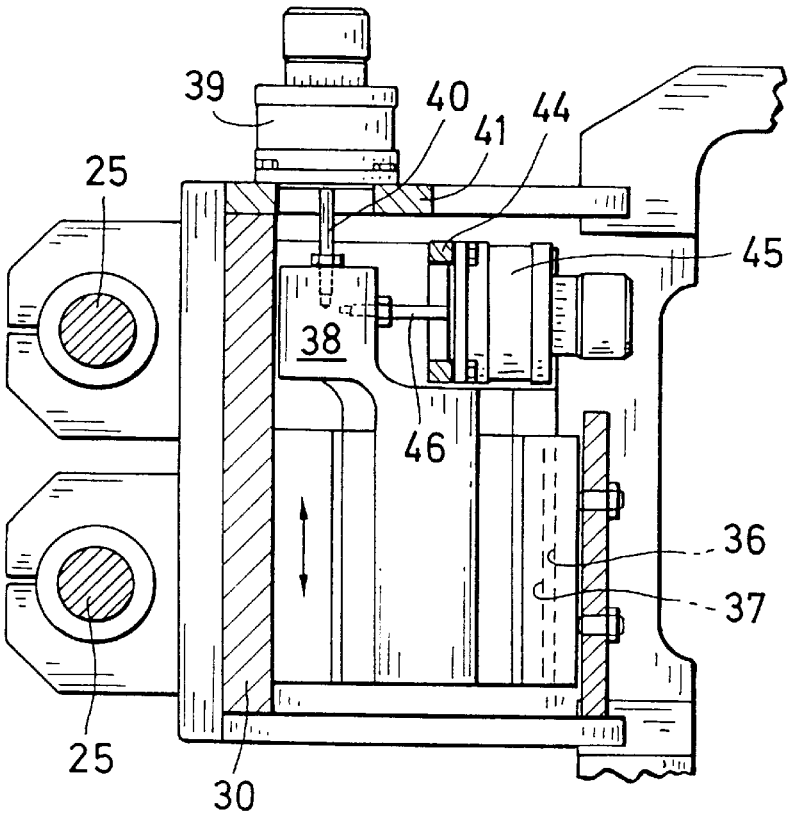
FIG. 8 is a view in the direction of the arrows VIII—VIII in FIG. 5.

At its underside the first carriage 38 carries two guide rails indicated at 42 in FIG. 7 which are of a corresponding profile to the guide rails 36 and which serve to guide two bar members 43 which are of a corresponding profile to the bar members 37. The bar members 43 are carried by a second carriage 44 which can be reciprocated in the direction of the Y-axis, that is to say, relative to the circular transport path of the machine as shown in FIG. 1, radially within the guide rails 42, and can thus be adjusted in that way. For that purpose the assembly has a second control or setting motor 45 which is carried by the second carriage 44 and whose spindle 46 is fixed to the first carriage 38. Displacement of the first carriage 38, which is produced by the first setting motor 39, occurs substantially transversely to the longitudinal extent of the spindle 46 of the second setting motor 45. As indicated above the spindle 46 is mounted to the first carriage 38.

Figure 10:
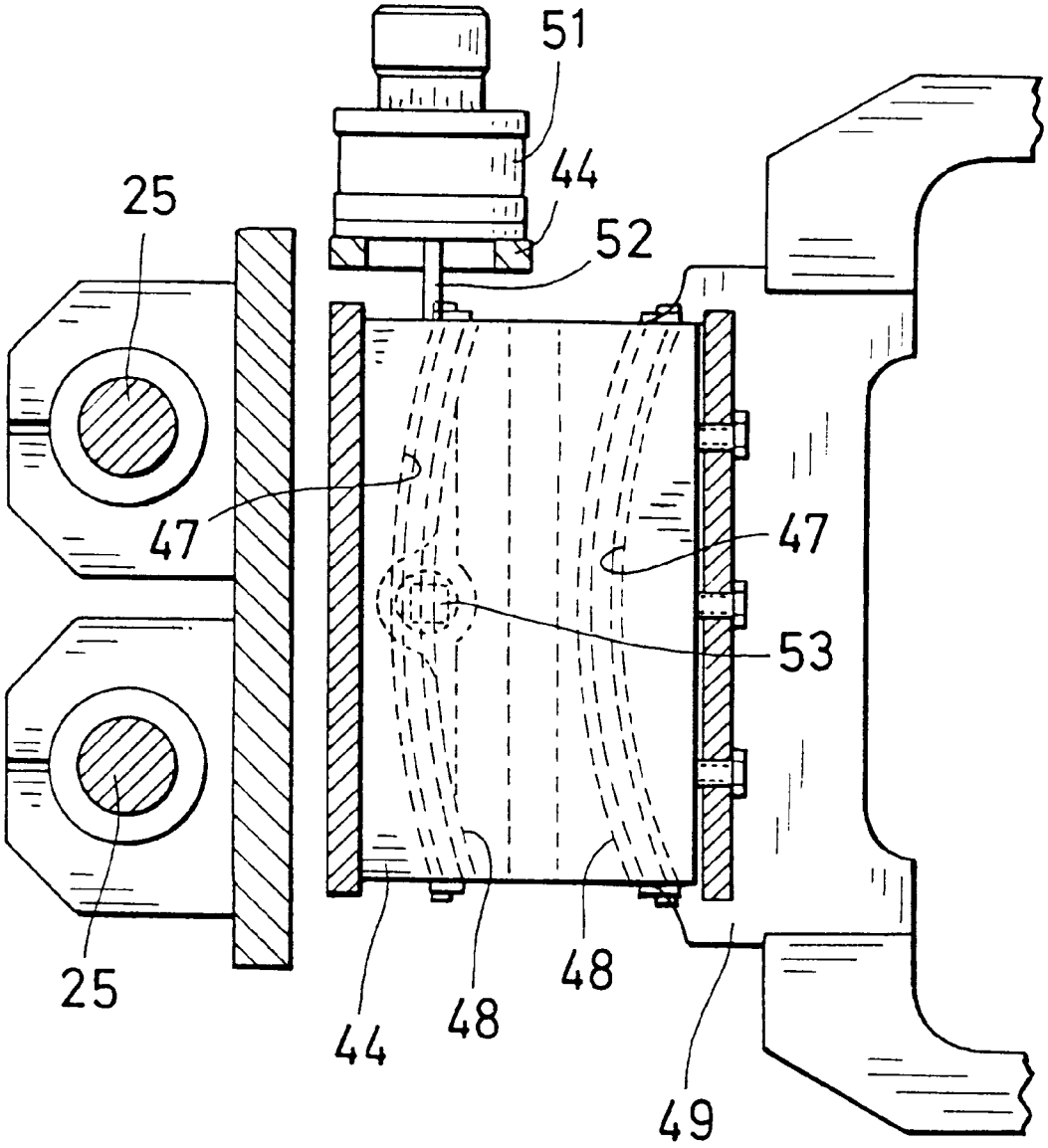
FIG. 10 is a view in the direction of the arrows X—X in FIG. 5.

At its underside the second carriage 44 carries two guide rails indicated at 47 in FIG. 5 which are of a corresponding profile to the guide rails 36 and 42 respectively for the first and second carriages 38 and 44 respectively, but which extend in an arcuate configuration as can be seen from FIG. 10. The guide rails 47 guide a third carriage which is indicated at 48 for example in FIG. 5 and whose side surfaces are of a V-shaped cross-sectional configuration, corresponding to the profiling of the guide rails 47.

Fixedly mounted to the third carriage 48 at the underside thereof is a substantially horizontally outwardly projecting support element which is indicated at 49 in FIG. 5. The support element 49 carries the screen printing stencil frame 26. The arrangement in this respect is such that the radius of the arcuate third guide assembly formed by the two guide rails 47 passes through the center point of the stencil. For that purpose the connection between the outwardly projecting support element 49 for the frame 26 and the third carriage 48 is of a positively locking nature so that there is no possibility of the frame 26 moving with respect to the third carriage 48.

Figure 9:
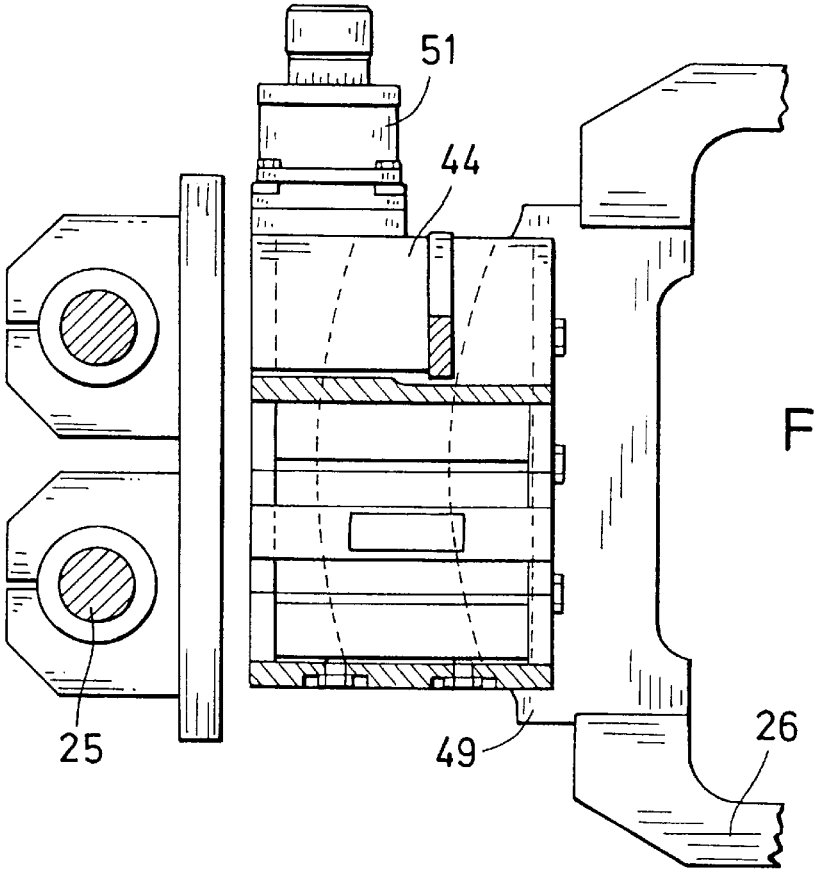
FIG. 9 is a view in the direction of the arrows IX—IX in FIG. 5.

Setting of the third carriage 48 relative to the second carriage 44 which carries it is effected by a third control or setting motor which is indicated at 51 in for example FIGS. 7 and 9 and which is fixed to the second carriage 44. The spindle of the setting motor 51, which is indicated at 52 in for example FIG. 10, is connected at its free end to a trunnion indicated at 53 in FIG. 10. The trunnion 53 is mounted rotatably about a vertical axis in a rear extension portion 54 (see FIG. 5) of the support element 49 for the frame 26. The rotatable mounting is required because displacement of the third carriage 48 takes place along a part of an arc. However, there is no need for the third setting motor 51 to be pivotably mounted on the second carriage 44 as the extent of the displacement involved in each case is very slight, being at a maximum a few millimeters, and thus the extent of the displacement which the trunnion 53 experiences upon displacement of the third carriage 48 is correspondingly small and is in the area of elastic deformability of the spindle 52.

Figure 6:
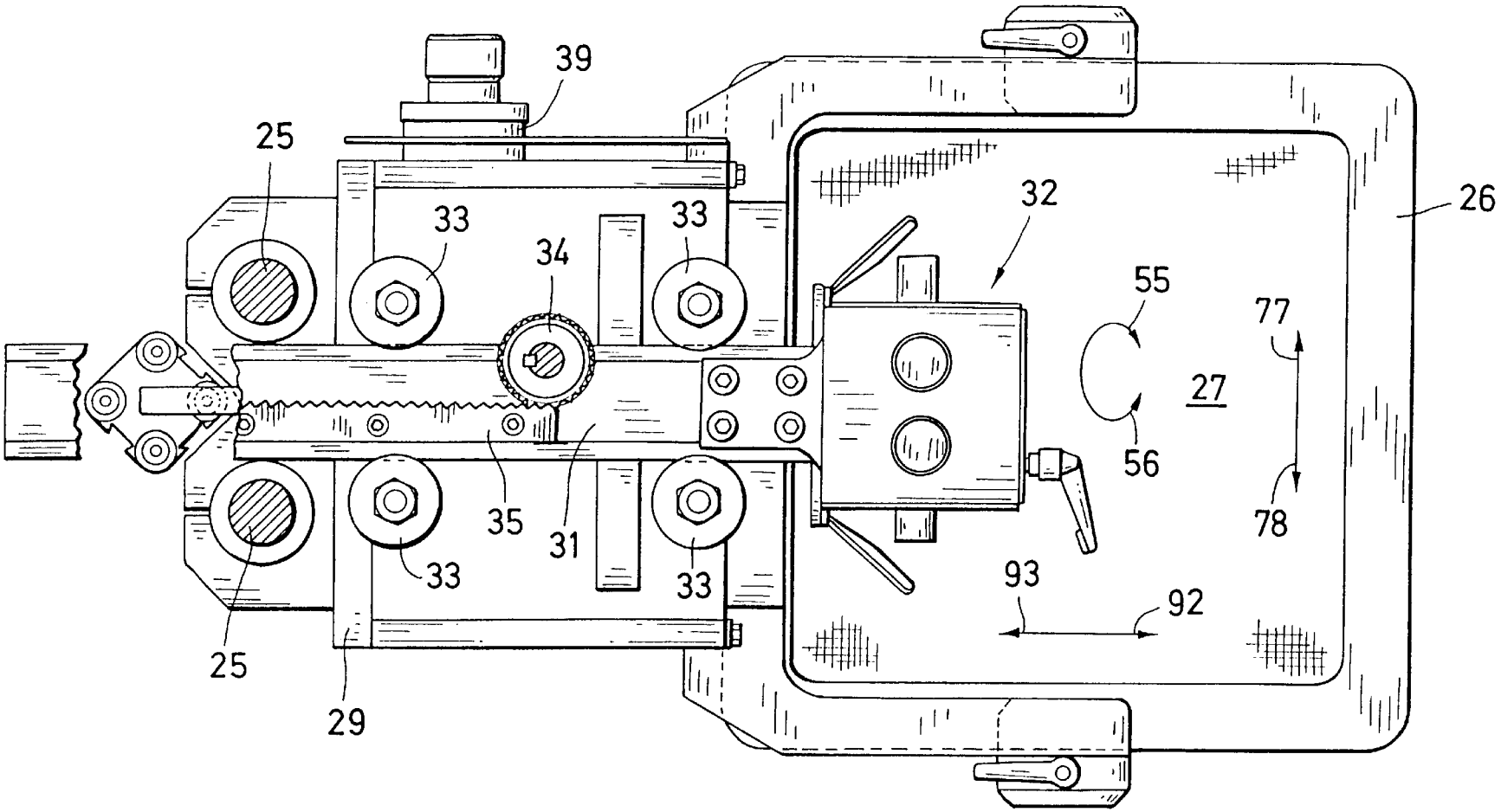
FIG. 6 is a view approximately in the direction of the arrows VI—VI in FIG. 5.

The frame 26 with the screen printing stencil 27 carried therein can be adjusted by the setting motors 39, 45 and 51 in accordance with the respective requirements involved, in the directions indicated by the arrows 77, 78; 92, 93; 56, 55 respectively in FIG. 6, that is to say linearly in two mutually perpendicular directions and in addition with a pivotal movement.

As the squeegee head 32 is carried by the bracket 30 which is connected to the main frame structure 10 of the machine, the squeegee head 32 does not participate in the setting movements of the screen printing stencil, which occur substantially in a horizontal plane.

Figure 2:
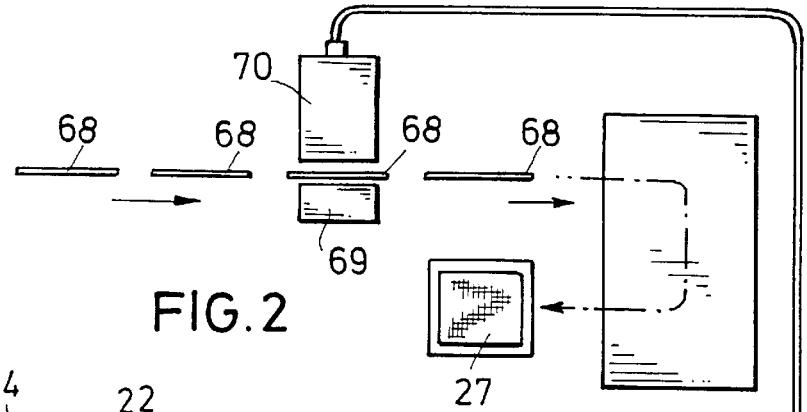
FIG. 2 shows a simplified circuit diagram of a means for adjusting the printing mechanisms of the apparatus of FIG. 1, FIGS. 3A–3C each show an article with a print image in a greatly simplified form.

In the individual printing stations indicated at II, III, IV and V, a respective individual print image is applied to each of the respective articles disposed in the holders 16 of the table 12 which rotates with a stepwise movement. All the individual print images supplement each other on each article, after passing the last printing station V, to constitute a total print image which, in the embodiment illustrated in FIGS. 1 and 2, is made up of four partial print images. Arranged downstream of each of the printing stations II and V is a respective drier 57 for drying the printing ink applied in the respectively preceding station. Driers of that kind may also be disposed downstream of the other printing stations III and IV.

A camera system is operatively associated with the removal station VI in such a way that the article bearing the total print image, before being removed from the holder, is recorded by a camera 58 forming part of the camera system. It will be appreciated that it is also possible to provide a particular station for the camera system, which station is arranged upstream of the removal station VI in the direction of rotation as indicated by the arrow 18 of the table 12, it this should be necessary for example for reasons concerning the amount of space required. FIG. 2 shows that the output of the camera system is connected by way of a line 60 to a computer 62 with which a video display screen 64 is associated, for visually representing the respective print image recorded by the camera. In the computer 62, the actual position of the print image recorded by the camera 58 is compared to the reference or target position of that print image, which is stored in the computer 62. The result of the comparison operation is passed by way of a line 65 to a programmable control unit 66 from which lines 20*a*, 21*a*, 22*a*, 23*a* lead to the setting motors 39, 45, 51 of the individual printing mechanisms in the printing stations 20, 21, 22, 23.

The reference positions, stored in the computer 62, in respect of the individual print images to be respectively applied to the articles in the stations 20, 21, 22, 23, can be inputted into the memory means of the computer in such a way that the diapositives 68 corresponding to the individual print images are put on to a suitable item of equipment such as a light or projection table as indicated at 69 in FIG. 2 and successively recorded by a camera 70, in which case the diapositive which is respectively disposed on the table 69 is oriented in a defined manner relative to the camera 70 so that all reference positions recorded thereby are also fixed in relation to each other. The successively recorded individual print images are fed by way of lines 71, 72 to the computer 62 and stored therein. The interposed display screen 74 only serves to view the respectively recorded individual print image.

After detection by the camera 70 the respective diapositive 68 can then be used in the normal manner to produce the respective print image of the screen printing stencil 27.

As a departure from detecting the respective reference position by means of the camera 70 however it is also possible for data corresponding to the reference position to be introduced on a data carrier directly into the computer 62, as is indicated by the arrow 76 in FIG. 2.

Figure 3A:
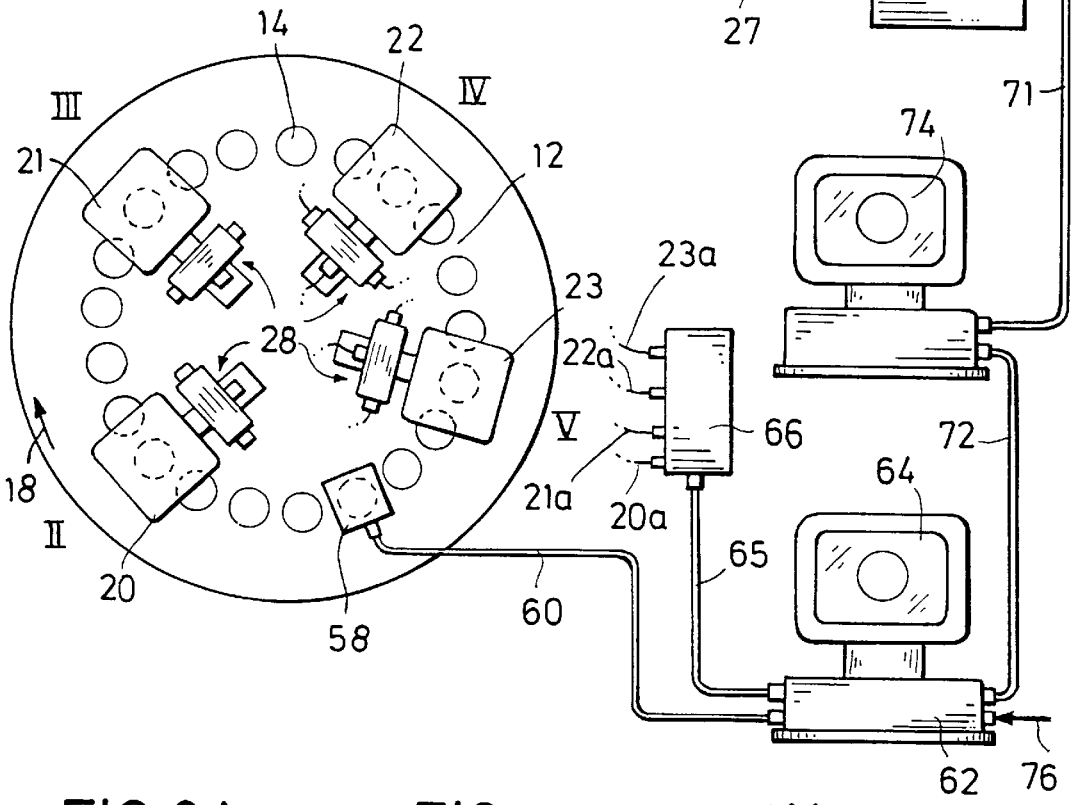
Figure 3C:
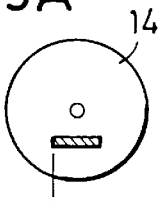
Figure 3B:
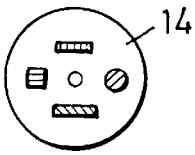
Figure 4:
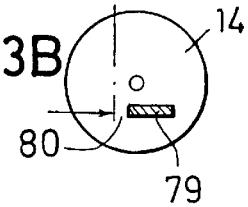
FIG. 4 is a plan view of a screen printing stencil for producing the individual print image shown in FIGS. 3A and 3B.
Figure 4:
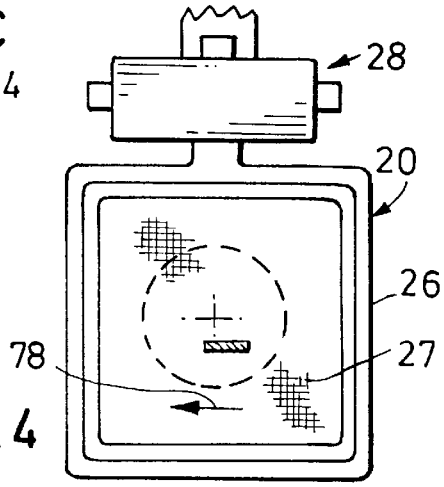

For the purposes of setting the screen printing stencils of the printing mechanisms 20, 21, 22, 23 in the stations II through V after a change of stencils, the procedure adopted can be such that firstly, for setting the screen printing stencil 27 of the printing mechanism 20, only one article is provided in the station II with an individual print image and then, after passing the following stations, it is detected by the camera system 58 at the removal station VI. The computer 62 then effects comparison of the detected actual position of that individual print image produced in the printing station II with the reference position thereof. If the actual position deviates from the reference position, correction of the position of the screen printing stencil 27 of the printing mechanism 20 is effected by suitable actuation of at least one of the setting motors. If for example FIG. 3A shows the reference position of the individual print image applied in the station II and FIG. 3B shows the actual position thereof, the result of a comparison between that actual position and the reference position would be that the setting motor 39 would be switched on by way of the control unit 66 and the line 20*a* associated with the printing station II, in such a fashion that the screen printing stencil 27 carried by the frame 26 is displaced in the direction indicated by the arrow 78 in FIG. 6 by an amount corresponding to the distance indicated at 80 in FIG. 3B, by which the actual position deviates from the reference position.

After correct setting of the screen printing stencil of the screen printing mechanism 20 in the station II, the screen printing stencil of the printing mechanism 21 in the printing station III would be set in a corresponding manner. In that case, the reference position of the printing mechanism 21 would have to be brought into operation in the computer 62 for carrying out the appropriate comparison operation in this context. The screen printing stencils in the other stations would be set in a corresponding manner. Then, after the screen printing stencils of all printing mechanisms have been suitably set, it is possible to begin with the printing operation, as the normal production procedure.

It is also possible however, for the purposes of final setting of the screen printing stencils of all printing stations, firstly to apply all individual print images to an article and to have the resulting total print image recorded by the camera system 58. In that case, the actual positions of the individual print images are successively compared in the computer 62 to the respectively associated reference position. For that purpose it would only be necessary for the camera system 58 and/or the computer 62 to be able to separately detect and evaluate the individual print images. That is readily possible from a technical point of view as the individual print images are normally of different colors and the color differences can be recognised by the camera system 58 and/or the computer 62.

In this alternative procedure, it is also possible, after the final setting of the screen printing stencils, which is effected before beginning production, for adaptation to the respective reference position, to monitor the quality of the total print image even during subsequent production by comparison of the respective actual positions of the individual print images and the respectively associated reference position, in order in that way to detect and correct any deviations which could occur during the normal production procedure. The monitoring operation could be continuous in nature or could be in the manner of a random sample procedure.

For initial setting of the screen printing stencils of the printing mechanisms, instead of using articles it would be possible to use any substitute articles which are of a suitable configuration, if that is advantageous for example for reasons of cost, so that the 'genuine' articles are only introduced into the apparatus when all the printing mechanisms have been correctly set. It may possibly also be advantageous, for the purposes of initial setting of the screen printing stencils, to carry out two or more printing procedures, in which case the stencil is moved from the actual position into the reference position in a stepwise movement, that is to say by a given amount after each printing operation. Whether a plurality of setting steps is required for that initial setting procedure may also depend on the magnitude of the difference between the actual position and the reference position.

Reference will now be made to FIGS. 11 through 14 showing an embodiment of an apparatus for printing on individual self-supporting flat articles such as credit cards, telephone cards or the like. Cards of that kind are typically for example 0.6 mm in thickness. They are printed using an offset printing procedure, although it is not out of the question for other printing procedures, for example screen printing, to be additionally employed. The offset printing procedure however makes it possible to apply print images of highly accurate detail in many colors and intermediate shades, by virtue of the use of a high-resolution scanning pattern print process.

Figure 11:
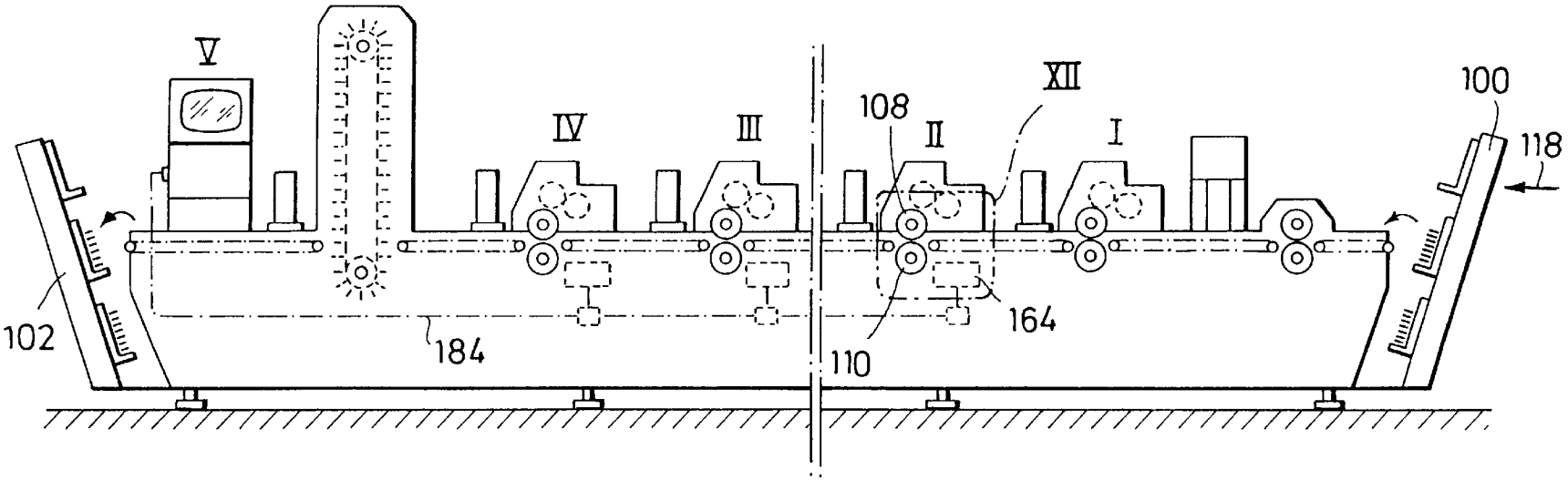
FIG. 11 is a side view of a printing machine for printing cards.

Referring to FIG. 11, it will be seen therefrom that the apparatus is of a substantially linear structure in such a way that articles to be printed are supplied to the machine at one end thereof from a magazine unit 100 and, after passing through a plurality of printing stations and other treatment stations, are received at the other end of the machine by a collecting unit 102 and are there fed to other items of equipment for further treatment or use. As this embodiment involves first and second articles being transported in pairs through the apparatus and treated thereby, as can be clearly seen from FIG. 13, the spacing between the two units 100 and 102 is bridged over by first and second parallel transport paths generally indicated at 104 and 106 in FIG. 13, which may each have a plurality of successive different transport devices. Any suitable form of transport devices can be used in this respect. In this connection and in regard to further features attention is directed to DE 19534827, the disclosed content of which is incorporated herein by virtue of reference thereto.

The apparatus has a plurality of offset printing stations of which FIG. 11 shows the stations I, II, III and IV. In that arrangement, a primer can be applied to the cards in the printing station I, whereas at least some of the following printing stations involve applying individual print images of given colors and of a given pattern, with all the individual print images on a respective article supplementing each other to make up a total print image. Arranged below the printing cylinder 108 is a backing or impression cylinder 110 which, during the printing operation, supports the two cards which are printed in one working operation and which, in the printing procedure, are passed between the two cylinders 108 and 110 in the usual manner. The printing cylinder 108 is provided in the usual fashion with a printing blanket 112 which receives an application of ink from a plate cylinder as indicated at 114 in FIG. 12.

In situations in which the cards to be printed have a cavity for accommodating a chip or the like, during the operation of printing on the flat surface of the card which does not have the cavity, it is necessary for the card to be especially supported at the side thereof which is opposite that surface. For that purpose the impression cylinder 110 is provided with at least one substantially radially arranged punch portion which projects somewhat with respect to the peripheral surface of the impression cylinder 110 and which, during the operation of printing on the side of the card which does not have the cavity, engages into the cavity to support the bottom thereof.

The fact that individual print images which supplement each other on an article to make up a total print image are applied in a plurality of successive printing stations means that it is necessary for the cards to be carefully aligned with respect to the respective printing mechanism. In addition the presence of the above-mentioned punch portion on the backing cylinder 110 also means that it is necessary for the backing cylinder to be accurately positioned and oriented.

Figure 12:
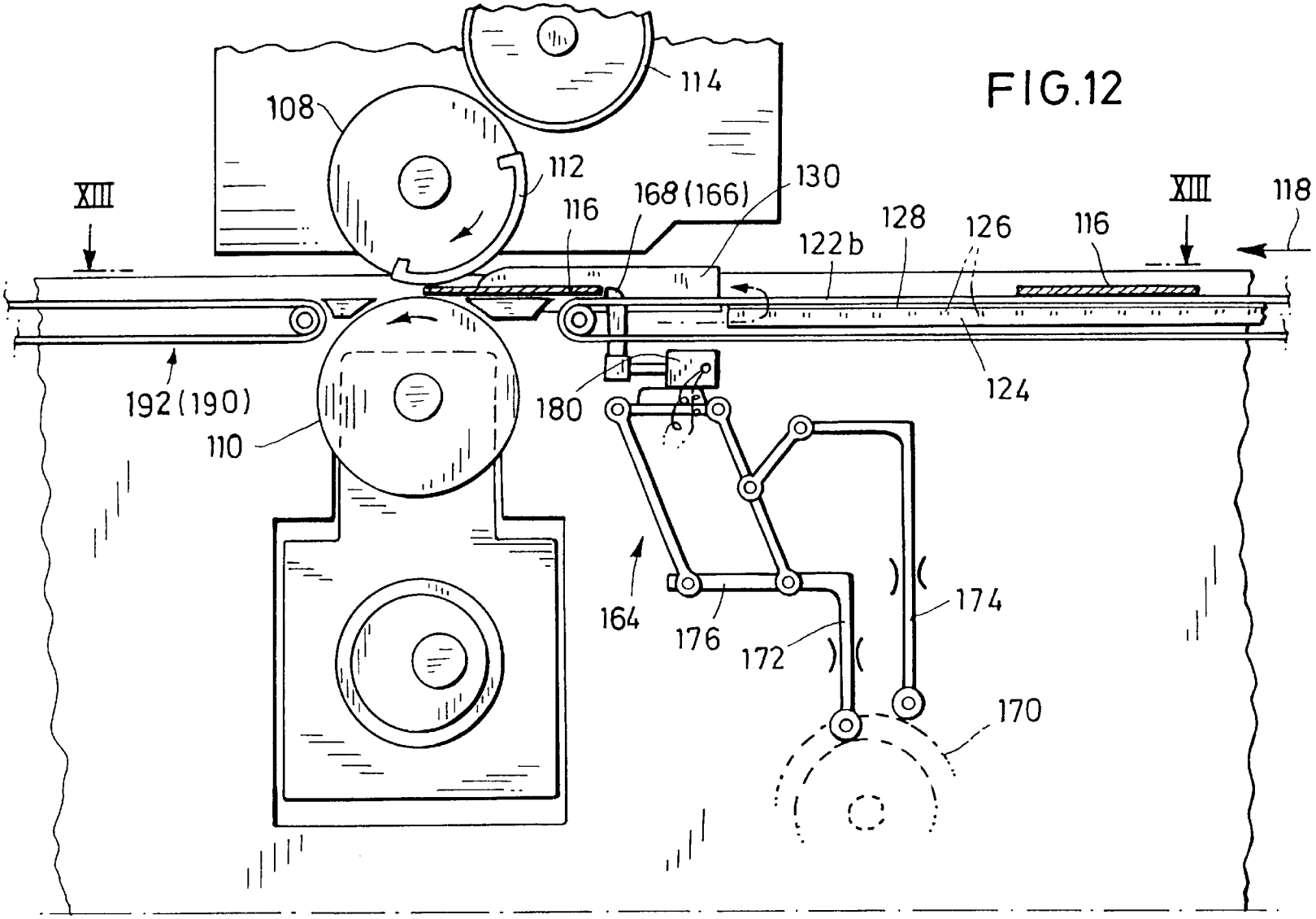
FIG. 12 is a view on a substantially larger scale of the portion indicated at XII in FIG. 11.
Figure 13:
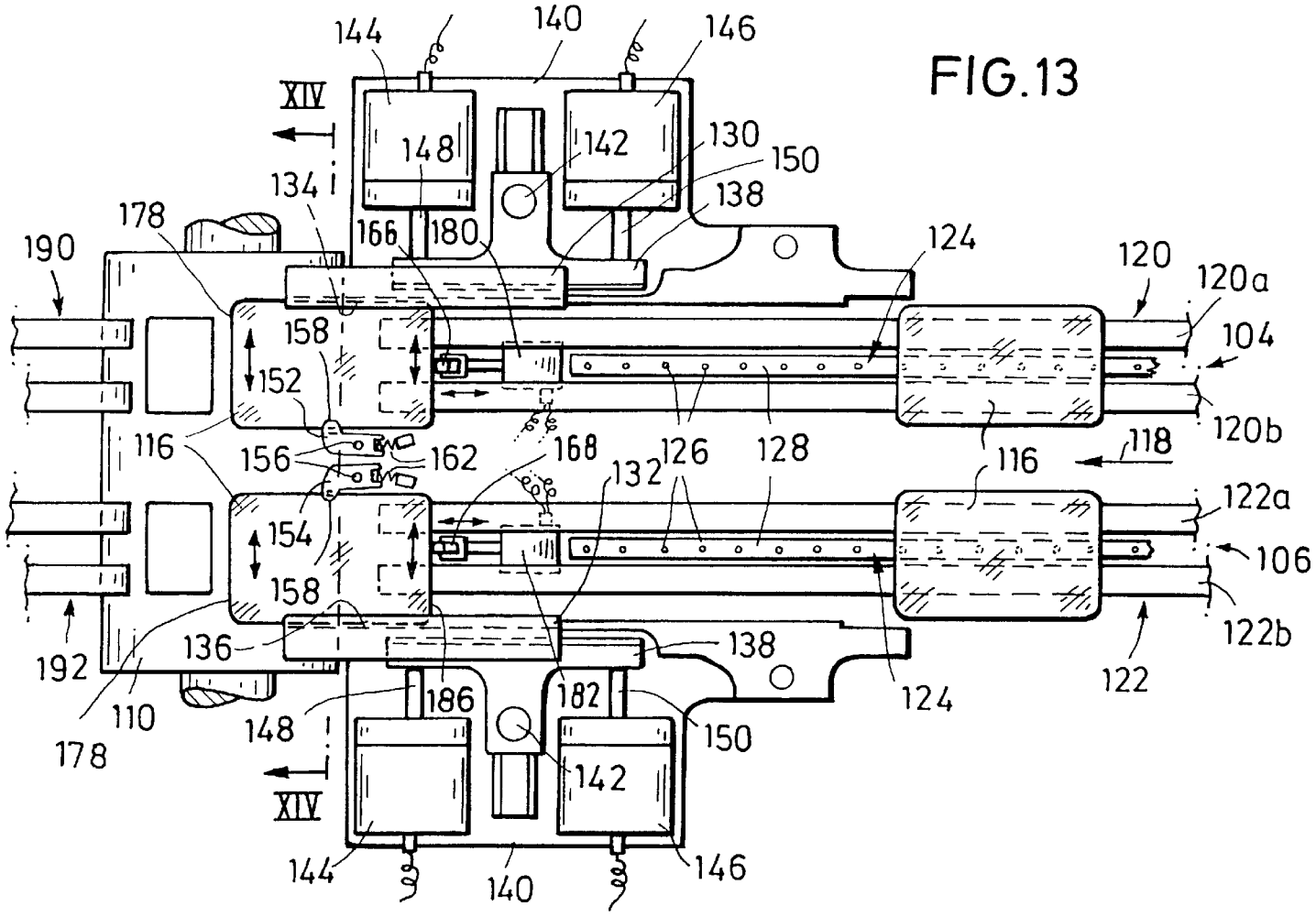
FIG. 13 is a view approximately in the direction of the arrows XIII—XIII in FIG. 12.

Referring now to FIGS. 12 and 13, it will be seen that each card 116 of the pair that is to be printed upon at the same time is transported in the transport direction 118 by a pair of belts indicated at 120 and 122 into an aligning station for the following printing operation. Arranged between the two belts 120*a*, 120*b* and 122*a*, 122*b* respectively of each pair is a suction bar indicated at 124 in FIG. 12. The upper boundary surface 128 thereof, which has suction openings 126, is disposed at a small spacing below the level of the transporting belts 120*a*, 120*b* and 122*a*, 122*b* respectively. The cards are held pressed against the belts supporting them by the reduced pressure generated by means of the suction effect beneath the cards, so that, even at a high speed of transportation movement, the cards are guaranteed to be entrained, and reliable positioning on the belts of the respective pair is assured. Associated with the aligning station of each of the two transport paths 104, 106 is an aligning rail as indicated at 130 and 132 in FIG. 13 which, at its side towards the respective pair of belts, carries a guide surface 134, 136. That surface is of a V-shaped cross-sectional configuration, as can be seen in particular from FIG. 14. In the transport direction 118, the suction bars 124 terminate just prior to the plane which extends transversely to the transport direction 118 and in which the guide rails 130 and 132 begin. For reasons of space, in the embodiment illustrated in FIGS. 11 through 14 the guide rails 130 and 132 are each arranged on the outside, that is to say at the side of a pair of belts 120 and 122, which is remote from the respective other pair. The pairs of belts 120, 122 terminate approximately at the mid-length position of the respectively associated guide rails 130 and 132 respectively.

Each of the two guide rails 130 and 132 is mounted to a support rail indicated at 138 in FIG. 13, which extends parallel to the respectively associated guide rail and is mounted pivotably on the machine frame 140 about a vertical axis 142. The pivot axis 142 therefore extends substantially perpendicularly to the main plane of the cards 116 which are in the transport paths 104 and 106 respectively. Associated with each support rail 138 are two setting motors 144 and 146, in such a way that the pivot axis 142 is between the two setting motors 144, 146 or the spindles 148, 150 thereof, which are connected to the respective support rail 138.

Figure 14:
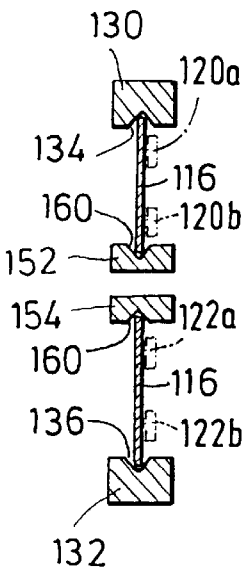
FIG. 14 is a view in section taken along line XIV—XIV in FIG. 13.

Provided at the side of each transport path 104, 106, which is opposite to the guide rails 130, 132 respectively, is a double-arm guide finger 152, 154 which is pivotable about an axis that is parallel to the axis 142, that is to say a vertical axis as indicated at 156 in FIG. 13. At its one arm, each guide finger 152, 154 is provided with an extension portion 158 which is directed towards the respectively associated card 116 and which, as can be seen in particular from FIG. 14, is also provided with a guide surface 160 of V-shaped cross-section. The other arm of each guide finger 152, 154 is acted upon by a spring 162 in such a way that the arm with the guide surface 160 is urged against a longitudinal edge of the respectively associated card 116, as can be seen in particular from FIG. 13.

For transporting the cards 116 into the printing mechanism, the apparatus has an additional transport assembly which is indicated at 164 in FIG. 11 and which has two entrainment members indicated at 166 and 168 in FIG. 13.

Each of them is associated with a respective one of the two transport paths 104, 106 or the respectively associated pair of belts 120, 122. As shown in FIG. 12 the transport assembly 164 is provided with two levers 172, 174 controlled by a cam disk 170, and a parallelogram linkage 176 carrying the entrainment members 166, 168. Upon being driven by the cam disk 170 the entrainment members 166, 168 perform reciprocating movements substantially in the transport direction as indicated by the arrow 118 and in the opposite direction thereto and downwardly and upwardly directed movements, in which case the entrainment members, in moving in the opposite direction to the transport direction 118, are below the level of the cards 116 lying on the pairs of belts 120, 122. In the upper position of the entrainment members 166, 168 they are respectively disposed between the two toothed belts 120*a*, 120*b* and 122*a*, 122*b*. In that situation the entrainment members 166, 168 engage behind the card which is disposed on the respective pair of belts and which is then displaced by the entrainment members in the transport direction 118 until the edge of the card which is the leading edge in the transport direction 118 is engaged by the two cylinders 108, 110 of the printing mechanism and, in the course of the printing operation, is moved by the cylinders 108, 110 towards two subsequently disposed pairs of belts 190, 192.

An important consideration in that respect is that the entrainment members 166, 168 are carried by the transport assembly 164, with the interposition of setting motors as indicated at 180 and 182 in FIG. 13, with the setting motor 180 also being shown in FIG. 12, in such a way that the position of the respective entrainment member can be adjusted in the transport direction 118 and in the opposite direction thereto, relative to the transport assembly 164.

Referring at this stage to FIG. 11, it will be seen therefrom that, before leaving the apparatus, the printed articles pass through a checking station V provided with a camera system that is not shown in detail and the other items of equipment which are described with reference with FIG. 2 and which permit a comparison between the actual print image or the actual position thereof and the reference print image or the reference position thereof. The computer at the station V is connected by way of lines 184 to the setting motors which are disposed in the aligning stations associated with the individual printing stations and which can be in the form of conventional stepping motors.

The two cards 116 which are to be transported in a direction towards the printing station are moved by the respective pair of belts 120, 122 in the transport direction 118 to such an extent that their rear boundary edge as indicated at 186 in FIG. 13 is disposed in the transport direction downstream of the respective suction bar 124 and thus the entrainment member 166 or 168, at the end of its movement in the opposite direction to the transport direction 118, on moving upwardly, can engage behind the respective card 116 in order to advance it in the transport direction 118 towards the printing mechanism, in the subsequent movement of the respective entrainment means in the raised position as shown in FIGS. 12 and 13. Normally the card is transported by the respectively associated pair of belts 120 and 122 by a distance such that the leading edge 178 thereof is disposed approximately in the region of the associated guide finger 152, 154. By virtue of the guide finger 152, 154 being acted upon by the spring 162, there is a certain frictional resistance which prevents the card from being further entrained by the pair of belts 120 or 122 respectively. In that case however, as already mentioned, the card assumes a position which permits the respective entrainment member 166, 168 to engage behind the card at its trailing edge 186 so that further movement of the card in the transport direction 118 is produced by the entrainment member which also overcomes the frictional resistance between the guide rail 130 or 132 respectively and the associated guide finger 152 and 154 respectively. In that movement along the guide rail the fact that the card is pressed by the guide finger 152 or 154 against the guide rail means that the card is aligned transversely with respect to the transport direction, such alignment being determined by the position of the guide rail 130 or 132 respectively. Alignment of the card in the transport direction 118 is effected by virtue of the position of the respective entrainment member 166, 168. As the transport assembly 164 carrying the entrainment members 166, 168 always performs the same movements which are determined by the cams of the cam disk 170, suitable positioning of the entrainment member 166 or 168 by the respectively associated setting member can also establish the position of the card 116 which it adopts relative to the periphery of the printing cylinder 108 or the printing blanket 112 disposed thereon.

The essential difference between the embodiment shown in FIGS. 1 through 10 and the embodiment shown in FIGS. 11 through 14 is that in the former the printing mechanisms, namely the screen printing stencils, were oriented and aligned relative to the article to be printed upon, whereas in the embodiment of FIGS. 11 through 14 it is the articles to be printed upon that are aligned and oriented relative to the printing mechanism. Apart from that difference however the two embodiments are the same in terms of the basic operating procedures involved. Thus a card or a pair of cards can initially be provided in the station II with an individual print image which is detected in the checking station V and compared to the reference position stored therein.

In the event of the actual position deviating from the reference position, at least one of the three setting motors of each aligning station is suitably actuated. If the respective guide rail 130 or 132 has to be displaced for the purposes of correcting the position and/or the angular location of the respective card, in a normal situation it is sufficient to actuate one of the two setting motors 144, 146 as generally the extent of the displacement required is so slight that the pivotal movement of the guide rail caused by actuation of a setting motor is in the area of elastic deformability of the component of the other setting motor, which is connected to the guide rail.

There is no need for particular alignment and orientation of the card 116 in regard to its position in respect of height as the V-shaped configuration of the guide surfaces on the guide rail and the guide finger co-operating therewith means that the card is always held in the deepest point of the V-shaped recess in the two components. The positively locking engagement between the card and the guide finger, which is produced by virtue of the V-shaped configuration, also ensures that the card cannot perform an uncontrolled movement under the effect of the forces applied to the light card by the entrainment member 166 or 168 respectively. The guide rail and the guide finger co-operating therewith represent a positive guide configuration which is operative until the card is engaged by the printing mechanism, that is to say the two cylinders 108 and 110, and is pulled out of the guide arrangement formed by the guide rail and the guide finger. Accordingly the entrainment member 166, 168 only needs to perform in the transport direction 118 a stroke movement which approximately corresponds to half the length of the card 116 in the transport direction.

It may be desirable for the basic setting of the printing mechanism to be so selected that the arrangement of the print image on the printing blanket 112 of the printing cylinder 108 requires slight inclined positioning of the guide rail 130 or 132 respectively, in such a way that the spacing of the guide rail from the center line of the transport path 104 or 106 respectively in the horizontal plane increases somewhat in the transport direction 118. In the view shown in FIG. 13, that would mean that the spacing between the two guide rails 130, 132 or the guide surfaces 134, 136 increases somewhat in the transport direction 118. That ensures that, after transportation by the respective entrainment member 166 and 168 respectively and alignment afforded thereby, the card 116 always remains in its adjusted position when it is pulled out of the guide arrangement formed by the guide rail and the guide finger, by the cylinders 108 and 110 of the printing mechanism.

It will also be noted that the embodiment shown in FIGS. 11 through 14 also permits a monitoring procedure to be conducted during ongoing production, as has already been described above with reference to the embodiment shown in FIGS. 1 through 10. It will be appreciated that, when the apparatus has two transport paths 104 and 106 and when therefore two cards are simultaneously printed, it is necessary for the monitoring station V to include for each transport path a respective camera and downstream-disposed items of equipment for making the comparison between the actual position and the reference position as alignment and orientation of the card is effected upstream of the printing mechanism of each transport path separately, that is to say independently of the respective other transport path.

It will be appreciated that the above-described methods and apparatus according to the present invention have been set forth solely by way of example of the principles of the invention and various other modifications and alterations may be made therein without thereby departing from the spirit and scope of the invention.

What is claimed is:

1. A method of printing on individual self-supporting articles by applying successive individual print images to the article in at least one sequentially arrayed printing station of a printing mechanism, the print images supplementing each other on the article to make up a total print image, the method comprising the steps of:

(a) checking the printing mechanism for correctly positioning the print images on the article in each of the individual printing stations by:

(1) applying only one individual print image to each respective article;

(2) recording by a camera system located downstream from where the print image is applied, the individual print image applied to each article, after each article has passed through all the printing stations;

(3) comparing a representation of the actual position of the individual print image of each article relative to the article bearing the print image to a corresponding stored representation of a reference position of the individual print image in a computer; and (4) adjusting either the printing station in which the respective print image had been printed or the following article on which the respective print image is to be printed upon in accordance with the result of the comparison in the event the comparison shows a deviation of the actual position of the individual print image from the reference position thereof; and (b) printing articles containing all the individual print images applied in the successive printing stations required for producing the total print image, after the printing mechanism has been checked and if necessary adjusted.

2. A method as set forth in claim 1 wherein the reference print image is taken from an original transparency by a camera and inputted into a memory means of a computer.

3. A method as set forth in claim 1 wherein the reference print image is inputted in the form of digital data into a memory means of a computer.

4. A method as set forth in claim 1 wherein when the individual print image is applied to the article by screen printing, and in the event of the actual position of the individual print image deviates from the reference position the position of a screen printing stencil is correspondingly altered.

5. A method as set forth in claim 1 wherein when the individual print image is applied to the article using a printing cylinder, and in the event of the actual position of the individual print image deviates from the reference position the position of a following article is correspondingly altered for carrying out the printing operation thereon.

6. A method as set forth in claim 1 wherein after adjustment of the printing mechanism for adaptation of the actual position of the individual print image to the reference position thereof the operation of printing following articles is continued without further comparison between the actual position and the reference position.

7. A method as set forth in claim 1 wherein after adjustment of the position of said following article for adaptation of the actual position of the individual print image to the reference position thereof the operation of printing following articles is continued without further comparison between the actual position and the reference position.

8. A method as set forth in claim 1 wherein after initial setting of the position of the printing mechanisms for the printing procedure when printing upon further articles at least random check monitoring of the actual position of the total print image and corresponding comparison with the reference position of the individual print images are effected.

9. A method as set forth in claim 1 wherein after initial setting of the position of a said following article for the printing procedure when printing upon further articles at least random check monitoring of the actual position of the total print image and corresponding comparison with the reference position of the individual print images are effected.

* * * * *